US008046856B2

(12) United States Patent
Schaub et al.

(10) Patent No.: US 8,046,856 B2
(45) Date of Patent: Nov. 1, 2011

(54) METHOD FOR SPIN-DRYING TEXTILES AFTER AN IMPREGNATION PROCESS

(75) Inventors: Hartmut Schaub, Berlin (DE); Ingo Schulze, Panketal/Zepernick (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1005 days.

(21) Appl. No.: 11/795,359

(22) PCT Filed: Nov. 21, 2005

(86) PCT No.: PCT/EP2005/056118

§ 371 (c)(1),
(2), (4) Date: Jul. 12, 2007

(87) PCT Pub. No.: WO2006/079429

PCT Pub. Date: Aug. 3, 2006

(65) Prior Publication Data

US 2008/0083132 A1 Apr. 10, 2008

(30) Foreign Application Priority Data

Jan. 26, 2005 (DE) ..... 10 2005 003 695

(51) Int. Cl.
*D06F 49/00* (2006.01)
*F26B 5/08* (2006.01)

(52) U.S. Cl. ..... 8/159; 68/12.02; 68/12.18; 68/12.23; 68/15

(58) Field of Classification Search ..... 68/12.02, 68/12.04, 12.06, 12.12, 12.14, 12.15, 12.18, 68/23.1, 23.2, 12.23, 15; 8/158, 159
See application file for complete search history.

(56) References Cited

U.S. PATENT DOCUMENTS 5,325,677 A * 7/1994 Payne et al. ..... 68/12.04
5,647,232 A * 7/1997 Boldt et al. ..... 68/12.02
5,737,790 A * 4/1998 Badger et al. ..... 8/158
5,752,397 A * 5/1998 Bruntz ..... 68/12.12
(Continued)

FOREIGN PATENT DOCUMENTS

DE 34 19 662 11/1984
(Continued)

OTHER PUBLICATIONS

International Search Report PCT/EP2005/056118.

*Primary Examiner* — Joseph L Perrin
*Assistant Examiner* — Benjamin Osterhout
(74) *Attorney, Agent, or Firm* — James E. Howard; Andre Pallapies

(57) ABSTRACT

A method for spin-drying textiles being subjected to a method for the production of a hydrophobic effect in a washing machine. Textiles located within the drum are brought into contact with hydrophobing substances dissolved in the washing liquid. The drum is accelerated for a first number of spin pulses to reach a speed in a first spinning block when the washing liquid is removed from the outer tub, the speed being below a critical speed of rotation. The drum is accelerated in a second spinning block for a second number of spin pulses to reach a speed that is above the critical speed of rotation. The drum is accelerated in a third and final spinning block for a third number of spinning pulses to reach a maximum speed of rotation that is compatible with the washing.

33 Claims, 1 Drawing Sheet

U.S. PATENT DOCUMENTS

Figure 1:
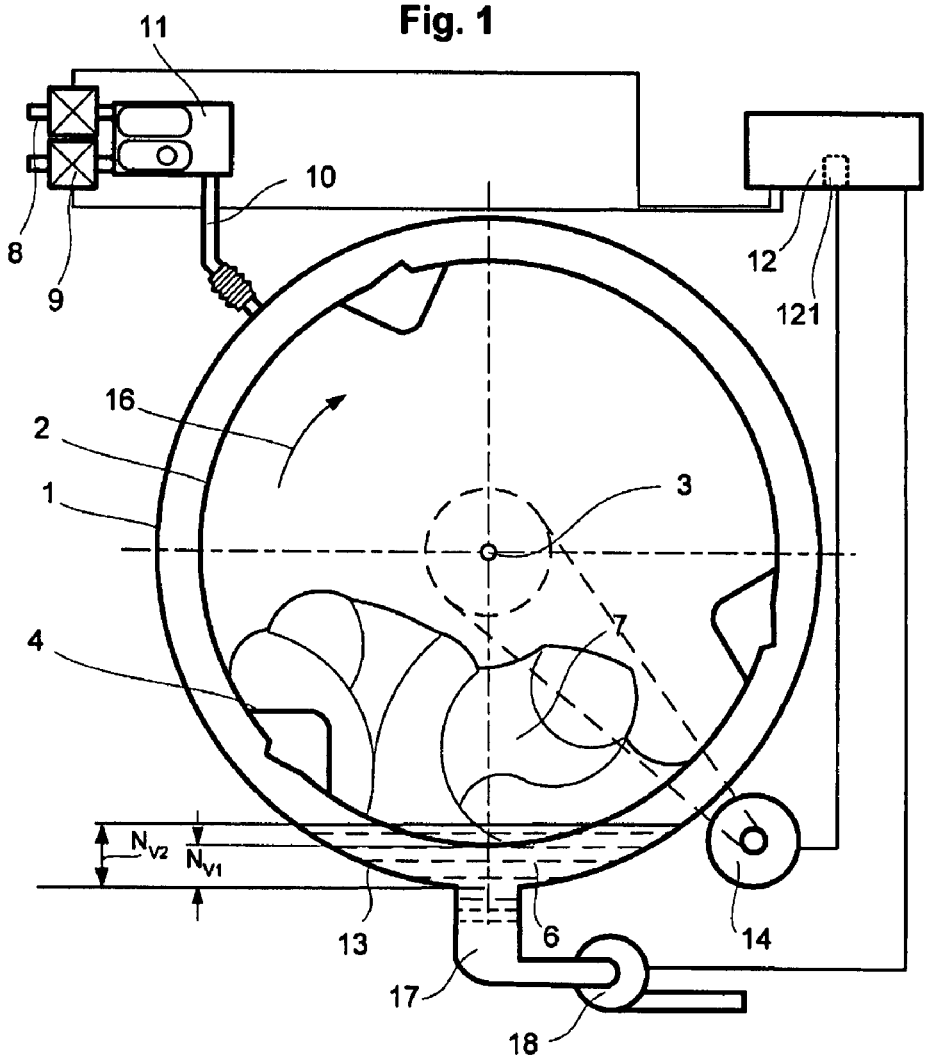

| | | | | |
|---|---|---|---|---|
| 5,765,402 | A * | 6/1998 | Ikeda et al. | 68/12.06 |
| 5,893,280 | A * | 4/1999 | Honda et al. | 68/12.06 |
| 2005/0028295 | A1* | 2/2005 | Jeon et al. | 8/158 |
| 2005/0284192 | A1* | 12/2005 | Altinier et al. | 68/12.06 |

FOREIGN PATENT DOCUMENTS

| | | |
|---|---|---|
| EP | 0 542 137 | 5/1993 |
| GB | 1 562 777 | 3/1980 |
| WO | WO 2006/066986 | 6/2006 |

* cited by examiner

METHOD FOR SPIN-DRYING TEXTILES AFTER AN IMPREGNATION PROCESS

The invention relates to a method for spinning textiles, which have been subjected in particular to a method for establishing a hydrophobic effect in a domestic washing machine with facilities for driving a washing drum, which is supported in a rotatable manner in an outer tub, and for controlling a washing process, with which method, during the course of a treatment process similar to a washing process, as the washing drum is being moved, the textiles supported in it are brought into contact with the water-repelling agents dissolved in the washing liquid.

Functional textiles such as top clothing, which is worn for protection against moisture from the air, gradually lose their water-repellent property, their waterproofing, during use. It is possible to restore this property by applying a water-repelling substance to the textile fibers. Generally this treatment is carried out on textiles in a commercial laundry or cleaning operation. However there is an increasing wish to be able to carry out such treatments in a domestic washing machine as well.

In the pertinent trade therefore water-repelling agents are available, which are suitable for use for waterproofing textiles in domestic washing machines. Such agents primarily consist of fluorocarbon resins or agents containing paraffin. Waterproofing can be carried out using a method according to a prior patent application by this applicant (2004P02110DE), with which the outer tub is filled with a quantity of water measured for a short washing liquid, in other words for a ratio of weight of the quantity of dry textiles to weight of the quantity of water of less than 1:8, which, as the textiles are being heated in the outer tub, is heated at least to the temperature recommended by the textile manufacturer as the treatment temperature (e.g. 40° C.), with which a predetermined quantity of the water-repelling agent is rinsed by water into the outer tub from a detergent chamber and forms the washing liquid together with the water and with which the textiles finally come into contact with the washing liquid for the first time and are treated for a period of maximum 30 mins. Finally the washing liquid is removed by spinning from the textiles and from the outer tub without rinsing.

Since when a standard spin process is used, no water ideally penetrates through hydrophobic textiles, such textiles will form air cushions when spun in the standard manner, said air cushions also containing a fairly large quantity of the residual waterproofing washing liquid. Therefore the degree of water removal that can be achieved will be disappointing using a standard spin process. Also such accumulations of waterproofing washing liquid residues will result locally in concentrations at defined points on the textiles, leaving white marks on the textiles after such a spin process.

The object of the invention is to set down a spinning method to be used specifically after textiles have been waterproofed in a machine, said method reducing the risk of white marks forming and allowing satisfactory water removal.

According to the invention this object is achieved by the features set out in the claims in the manner that after removal of the free water-repelling washing liquid from the outer tub the washing drum is accelerated in a first spin block for a first number of first spin pulses to a speed below a critical speed, at which the vibration system consisting of the outer tub and washing drum is in a state of resonance, that in a second spin block the washing drum is accelerated for a second number of second spin pulses to a speed above the critical speed, that in a third and final spin block the washing drum is accelerated for a third number of third spin pulses to a maximum speed that is still tolerable for the washing, that during all the spin blocks the washing liquid that is spun off is also removed from the outer tub and that between all the spin pulses the washing drum is operated at a slackening speed, at which the textiles are rearranged as they move around in the washing drum.

All the above measures allow a satisfactory degree of water removal from the textiles to be achieved, which can be around 70% residual moisture. It is also possible in the manner described to prevent accumulations of waterproofing washing liquid in defined regions of the textiles, so that the risk of white marks forming on the textiles is no longer a concern.

Advantageous developments of the inventive method are described in the subclaims and these can be used individually or in combination with each other.

Figure 2:
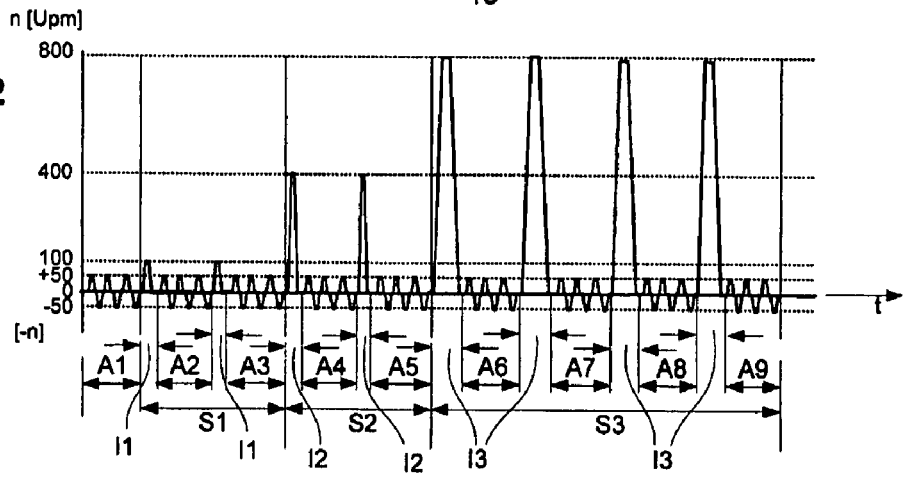

The invention is described below with reference to an exemplary embodiment illustrated in the drawing, in which FIG. 1 shows a schematic diagram of a washing machine with an outer tub and a washing drum supported therein to hold textiles and FIG. 2 shows a diagram of the time sequence of the inventive spin method.

The outer tub 1 in FIG. 1 contains a washing drum 2 supported therein about a horizontal axis 3 and having agitators 4 for a batch of washing 7, which consists of textiles. As the washing drum 2 rotates, the agitators 4 lift the washing 7 and let it fall back again to the bottom of the washing drum 2. This causes the washing to be wet, flowed through and mechanically processed in an intensive manner. An electric motor 14 serves to rotate the washing drum 2, inducing its rotational movement into the washing drum 2 by way of a belt drive. For spinning purposes the washing drum 2 is rotated in the direction shown by the arrow 16.

Activating one of the magnetic valves 8 or 9 causes washing liquid 6 to be introduced, filling the outer tub 1 to the $N_{v2}$. The washing liquid consists either only of water or a mixture of water and detergent. The washing drum 2 extends to a level $N_{v1}$, from which it can scoop the washing liquid 6.

Two chambers are shown in the detergent dispenser 11, through which fresh water flows respectively when the assigned magnetic valve is opened. Detergent in the chambers is then transferred by the water through the pipe 10 out of the detergent dispenser 11 into the outer tub 1. Washing liquid 6, which is at the bottom of the outer tub 1, can be conveyed out by the discharge pipe 17 and pump in a manner not shown in more detail here.

All the switchable or controllable facilities, such as the magnetic valves 8 and 9, the drum drive motor 14 and the drain pump 18, are switched or controlled by the control unit 12 of the washing machine, with the drive motor being switched or controlled by a special regulating unit 121. The speed of the drum drive motor is controlled by the special regulating unit 121, which can be a part of the control unit 12, as clearly shown in FIG. 1.

According to the invention the washing machine illustrated in FIG. 1 is operated further to a waterproofing process described in the prior patent application by this applicant (2004P02110DE) for example in a spin process, as shown in FIG. 2.

At the end of such a waterproofing process the drum movement initially ceases and the drain pump 18 starts to operate. This causes the free washing liquid in the outer tub 1 to be sucked out through the discharge pipe by the pump 18 and drained away. The otherwise usual rinse with clean water is intentionally dispensed with here, so that the maximum possible quantity of water-repelling agent, which is attached to the washing fibers, is also retained there.

Very soon after the pump starts to operate the drum drive switches to spin mode. In the diagram shown, when the free washing liquid has been drained away, the washing is first slackened in a slackening section A1. The slackening section is preferably operated with a reversing washing drum at a speed or 50 or fewer revolutions per minute. After the first slackening section A1 the washing drum is operated in a first spin block S1 with two first spin pulses 11 of 100 rpm each. This speed is still well below a resonance speed of the washing drum 2, which can be assumed to occur at approximately 250 rpm. The first spin block S1 with the two first spin pulses 11 is interrupted by a slackening section A2 and terminated by a further slackening section A3.

The subsequent second spin block S2 starts with a second spin pulse 12 with an increased speed of approximately 400 rpm, which is definitely above the resonance speed of the washing drum 2. The second spin block S2 also contains two spin pulses 12 and—like the first spin block S1—is interrupted and respectively terminated by slackening sections A4 and A5.

In the final spin block S3 the third spin pulses 13 achieve a final spin speed of maximum 800 rpm. So that quite a large amount of bound washing liquid can be spun off from the textiles, four spin pulses 13 are used for this, being similarly interrupted and respectively terminated again by slackening sections A6 to A9. This allows a residual moisture of approximately 70% to be achieved, which should be considered to be acceptable after a waterproofing program.

During the spin intervals the drain pump 18 remains in operation, so that the washing liquid driven out of the washing is drained away quickly. The large number of slackening sections prevents water bubbles, as described in the introduction, by rearranging the textiles and then spinning the washing liquid out of the washing.

It has proven that such a spin method is also suitable for removing water in a drip-free manner with the simplest of means from textiles, which—like heavily padded jackets—are difficult to remove water from, so that they resume their typical loose and voluminous form when they are subsequently air dried.

The invention claimed is:

1. A method for spinning textiles, which have been subjected in particular to a method for establishing a hydrophobic effect in a domestic washing machine with facilities for driving a washing drum, which is supported in a rotatable manner in an outer tub, and for controlling a washing process with a control unit, with which method, during the course of a treatment process similar to a washing process, as the washing drum is being moved, the textiles supported in it are brought into contact with water-repelling agents dissolved in a washing liquid, the washing liquid being at least partially formed by receiving a dose of a liquid detergent including the water repelling agents in a deter ent chamber and delivering the detergent from the detergent chamber to the outer tub, the washing liquid being heated within the outer tub by a heater, wherein:

removing the free washing liquid from the outer tub with a drain pump;

rotating the washing drum with a drive motor, and controlling the drive motor with a speed control unit that instructs the drive motor to rotate the washing drum in a first spin block for a first number of first spin pulses to a first speed being below a critical speed, the critical speed being a speed at which a vibration system including the outer tub and washing drum is in a state of resonance, in a second spin block for a second number of second spin pulses to a second speed being above the critical speed, and in a third and final spin block for a third number of third spin pulses to a maximum speed that is still tolerable for the washing;

removing with the drain pump the washing liquid from the outer tub that is spun off during all the spin blocks; and operating the washing drum with the drive motor, and controlling the drive motor with the speed control unit such that the speed control unit instructs the drive motor to rotate the washing drum in a slackening section at a slackening speed between each of the spin pulses, the slackening speed being a speed at which the textiles separate from the washing drum and are rearranged as they move around in the washing drum.

2. The method as claimed in claim 1, wherein the first number of first spin pulses is two.

3. The method as claimed in claim 1, wherein the first speed during the first spin pulses is maximum around 100 rpm.

4. The method as claimed in claim 1, wherein the first spin pulses each have a duration of about 10 seconds.

5. The method as claimed in claim 1, wherein the second number of second spin pulses is two.

6. The method as claimed in claim 1, wherein the second speed during the second spin pulses is maximum around 400 rpm.

7. The method as claimed in claim 1, wherein the second spin pulses each have a duration of about 10 seconds.

8. The method as claimed in claim 1, wherein the third number of third spin pulses is four.

9. The method as claimed in claim 1, wherein third speed during the third spin pulses is maximum around 800 rpm.

10. The method as claimed in claim 1, wherein the third spin pulses each have a duration of about 30 seconds.

11. The method as claimed in claim 1, wherein the slackening speed is around 30 rpm.

12. The method as claimed in claim 1, wherein operation of each slackening section lasts around 30 seconds.

13. The method as claimed in claim 1, wherein the duration of all the spin blocks in total is maximum 15 minutes.

14. A washing machine comprising:

an outer tub configured to retain a washing liquid;

a washing drum mounted within the outer tub, the washing drum rotating within the outer tub and configured to receive textiles for a waterproofing treatment;

a heater configured to heat the washing liquid within the outer tub;

a control unit that controls operation of the washing machine;

a detergent chamber configured to receive a dose of a liquid detergent including water-repelling agents and deliver the detergent to the outer tub at least partially forming the washing liquid with dissolved water-repelling agents, the water-repelling agents being brought into contact with the textiles within the washing drum;

a drain pump configured to remove the washing liquid from the outer tub;

a drive motor that rotates the washing drum; and a speed control unit that is configured to control the drive motor and is configured to instruct the drive motor to rotate the washing drum in a first spin block for a first number of first spin pulses to a first speed being below a critical speed, the critical speed being a speed at which a vibration system including the outer tub and washing drum is in a state of resonance, in a second spin block for a second number of second spin pulses to a second speed being above the critical speed, and in a third and final spin block for a third number of third spin pulses to a maximum speed that is still tolerable for the washing.

15. The washing machine as claimed in claim 14, wherein the speed control unit is configured to control the drive motor and is configured to instruct the drive motor to operate the washing drum in a slackening section at a slackening speed between each of the spin pulses, the slackening speed being a speed at which the textiles separate from the washing drum and are rearranged as they move around in the washing drum.

16. The washing machine as claimed in claim 15, wherein each slackening section includes the slackening speed being around 30 rpm and lasts around 30 seconds.

17. The washing machine as claimed in claim 14, wherein the first spin block includes the first number of first spin pulses being two, the first speed during the first spin pulses being maximum around 100 rpm, and the first spin pulses each having a duration of about 10 seconds.

18. The washing machine as claimed in claim 14, wherein the second spin block includes the second number of second spin pulses being two, the second speed during the second spin pulses being maximum around 400 rpm, and the second spin pulses each having a duration of about 10 seconds.

19. The washing machine as claimed in claim 14, wherein the third spin block includes the third number of third spin pulses being four, the third speed during the third spin pulses being maximum around 800 rpm, and the third spin pulses each having a duration of about 30 seconds.

20. The washing machine as claimed in claim 14, wherein the duration of all the spin blocks in total is a maximum of 15 minutes.

21. The washing machine as claimed in claim 14, wherein the control unit is configured to control the drain pump to remove from the outer tub the washing liquid that is spun off during each of the spin blocks.

22. The washing machine as claimed in claim 17, wherein the second spin block includes the second number of second spin pulses being two, the second speed during the second spin pulses being maximum around 400 rpm, and the second spin pulses each having a duration of about 10 seconds.

23. The washing machine as claimed in claim 22, wherein the third spin block includes the third number of third spin pulses being four, the third speed during the third spin pulses being maximum around 800 rpm, and the third spin pulses each having a duration of about 30 seconds.

24. The washing machine as claimed in claim 23, wherein each slackening section includes the slackening speed being around 30 rpm and lasts around 30 seconds.

25. The washing machine as claimed in claim 24, wherein the duration of all the spin blocks in total is a maximum of 15 minutes.

26. A washing machine comprising:

an outer tub configured to retain a washing liquid;

a washing drum mounted within the outer tub, the washing drum rotating within the outer tub and being configured to receive textiles for a waterproofing treatment;

a heater configured to heat the washing liquid;

a control unit that controls operation of the washing machine;

a detergent chamber configured to receive a dose of a liquid detergent including water-repelling agents and deliver the detergent to the outer tub at least partially forming the washing liquid with dissolved water-repelling agents, the water-repelling agents being brought into contact with the textiles within the washing drum;

a drain pump configured to remove the washing liquid from the outer tub;

a drive motor that rotates the washing drum; and a speed control unit that is configured to control the drive motor and is configured to instruct the drive motor to rotate the washing drum in a first slackening section at a slackening speed at which the textiles separate from the washing drum and are rearranged as they move around in the washing drum, then in a first spin pulse of a first spin block to a first speed being below a critical speed, the critical speed being a speed at which a vibration system including the outer tub and washing drum is in a state of resonance, then in a second slackening section at the slackening speed, then in a second spin pulse of the first spin block to the first speed, then in a third slackening section at the slackening speed, then in a first spin pulse of a second spin block to a second speed that is above the critical speed, then in a fourth slackening section at the slackening speed, then in a second spin pulse of the second spin block to the second speed, then in a fifth slackening section at the slackening speed, then in a first spin pulse of a third and final spin block to a third speed that is a maximum speed that is tolerable for the washing, then in a sixth slackening section at the slackening speed, and then in a second spin pulse of the third and final spin block to the third speed.

27. The washing machine as claimed in claim 26, wherein each slackening section includes the slackening speed being around 30 rpm and lasts around 30 seconds.

28. The washing machine as claimed in claim 26, wherein the first speed is less than around 100 rpm, and the spin pulses of the first spin block each have a duration of about 10 seconds.

29. The washing machine as claimed in claim 28, wherein the second speed is less than around 400 rpm, and the spin pulses of the second spin block each have a duration of about 10 seconds.

30. The washing machine as claimed in claim 29, wherein the third speed is less than around 800 rpm, and the spin pulses of the third spin block each have a duration of about 30 seconds.

31. The washing machine as claimed in claim 26, wherein the control unit is configured to control the drain pump to remove from the outer tub the washing liquid that is spun off during each of the spin blocks.

32. The washing machine as claimed in claim 26, wherein the second speed is less than around 400 rpm, and the spin pulses of the second spin block each have a duration of about 10 seconds.

33. The washing machine as claimed in claim 26, wherein the third speed is less than around 800 rpm, and the spin pulses of the third spin block each have a duration of about 30 seconds.

* * * * *